US005429102A

United States Patent [19]

Edwards et al.

[11] Patent Number: 5,429,102

[45] Date of Patent: Jul. 4, 1995

[54] FUEL SAVING DEVICE

[75] Inventors: Curtis S. Edwards, Thiells, N.Y.; Curtis H. Dawson, Philadelphia, Pa.

[73] Assignee: Anhydrous Devices, Inc., New York, N.Y.

[21] Appl. No.: 153,650

[22] Filed: Nov. 17, 1993

Related U.S. Application Data

[63] Continuation-in-part of Ser. No. 902,919, Jun. 23, 1992, abandoned.

[51] Int. Cl.[6] ..... F02M 29/04

[52] U.S. Cl. ..... 123/593; 48/189.6

[58] Field of Search ..... 123/590, 593; 48/189.6

[56] References Cited

U.S. PATENT DOCUMENTS

| | | | |
|---|---|---|---|
| 370,936 | 10/1887 | Drake | 261/122.1 |
| 484,721 | 10/1892 | Parris | 261/122.1 |
| 664,457 | 12/1900 | Bennett | 261/122.1 |
| 671,042 | 4/1901 | Barckdall et al. | 261/16 |
| 793,786 | 7/1905 | Helmle | 261/122.1 |
| 1,142,674 | 6/1915 | Crouch | 48/189.6 |
| 1,260,609 | 3/1918 | Warren | 123/593 |
| 1,265,047 | 5/1918 | Canova | 48/189.6 |
| 1,276,937 | 8/1918 | McKenney | 261/122.1 |
| 1,307,393 | 6/1919 | Dyer | 48/189.6 |
| 1,394,820 | 10/1921 | Fritz | 123/593 |
| 1,663,507 | 3/1928 | Parsons | 48/189.6 |
| 2,701,557 | 2/1955 | Ramey | 123/593 |
| 2,899,949 | 8/1959 | Hicks | 123/537 |
| 3,278,032 | 10/1966 | Smith | 210/181 |
| 3,999,526 | 12/1976 | Asfar | 123/522 |
| 4,011,847 | 3/1977 | Fortino | 123/522 |
| 4,020,812 | 5/1977 | Hayward | 123/593 |
| 4,253,954 | 3/1981 | Midkiff et al. | 210/168 |
| 4,361,128 | 11/1982 | Goldman et al. | 123/592 |
| 4,368,712 | 1/1983 | Jackson et al. | 123/523 |
| 4,426,984 | 1/1984 | Gilbert | 123/522 |
| 4,430,095 | 2/1984 | Gilbert | 48/180 |
| 4,491,118 | 1/1985 | Wooldridge | 123/593 |
| 4,492,212 | 1/1985 | Dooley | 123/590 |
| 4,858,582 | 8/1989 | Brown | 123/523 |
| 4,974,573 | 12/1990 | Jensen | 123/593 |

FOREIGN PATENT DOCUMENTS

| | | |
|---|---|---|
| 3135813 | 3/1983 | Germany . |

*Primary Examiner*—Willis R. Wolfe
*Assistant Examiner*—Erick Solis
*Attorney, Agent, or Firm*—Ohlandt, Greeley, Ruggiero & Perle

[57] ABSTRACT

A fuel saving device is provided that is adapted to be connected between the outlet of a carburetor and the inlet of an engine manifold in which the carburetor's throttle is modified to emit a constant amount of fuel and air. The device comprises a hollow housing having a first end adapted to engage the outlet of the carburetor and a second end adapted to engage the inlet of the engine manifold, from six to twelve screens positioned in the housing and a throttle positioned in the housing between the screens and the second end. In a preferred embodiment, the screens are positioned at three different locations within the device. At each location, the pair of screens are superposed one on another. The distance between each location should be one inch or less. Each screen has about 244 perforations per square inch, and each perforation is square in shape.

23 Claims, 3 Drawing Sheets

FUEL SAVING DEVICE

RELATED APPLICATION

This application is a continuation-in-part of application Ser. No. 07/902,919, filed Jun. 23, 1992, now abandoned.

BACKGROUND OF THE INVENTION

1. Field of the Invention

The present invention relates generally to a device for increasing fuel efficiency and reducing deleterious fuel emissions in a engine. More particularly, the present invention relates to a device adapted to be used with existing internal combustion engines that is readily positioned between the carburetor and an engine. The device is principally suited for a lawn mower engine, however it is anticipated that this device can be applied effectively to any engine that has a carburetor or fuel injector including an automobile engine.

With the increasing cost of fuel and the concerns with the deleterious by products that are emitted by fuel emissions, devices or apparatus and methods have been developed to maximize fuel efficiency in engines, especially automobile and other vehicle engines. In addition, some apparatus consequentially reduced unwanted fuel emissions, such as, carbon monoxide and hydrocarbons. These apparatus have been directed to optimizing the fuel to air ratio in the engine's or fuel injection system in order to maximize the fuel distribution and thereby increase fuel efficiency. One of the more common apparatus, and methods, has included controlling the mixture or ratio of fuel to air received in the engine. Other apparatus have been directed to modifications to the engine's carburetor to spread the air uniformly within the fuel.

Still other apparatus have included controlling and monitoring the fuel supplied to the engine to maximize the use of the fuel. Still other apparatus have converted conventional gasoline, methanol and the like into an aeriform gas to the improve the burn of the fuel and then introduce air into the fuel.

These apparatus have all fallen short of achieving the desired optimization of fuel efficiency achieved by the present invention. Also, these apparatus lave failed to achieve the minimization of the deleterious emissions normally caused by conventional burning of fuel.

2. Description of the Prior Art

Some prior art patents illustrate an apparatus that attempts to control the mixture of fuel and air ill a vehicle's engine in order to provide for efficient fuel consumption. These patents include, for example, U.S. Pat. No. 664,457, which issued to J. F. Bennett on Dec. 25, 1900, titled Carburetor that is directed to a carburetor that uses perforated plates to spread air bubbles over a larger surface area of the liquid gas. Also, U.S. Pat. No. 3,999,526, which issued to K. R. Asfar on Dec. 28, 1976, titled Vaporizing Carburetor is directed to a carburetor that acts to distribute evenly vaporized fuel in the airstream entering the vehicle's engine. The gasoline vapors are introduced into the atmospheric air directing a stream of air through the liquid fuel or gasoline.

U.S. Pat. No. 793,786, which issued to A. H. Helmle on Jul. 4, 1905, titled Carburetor is directed to an improved air fuel mixture for combustion within a gasoline engine, as is the present invention, however it creates the mixture in a completely different manner. This carburetor requires a compressed oxygen source to supply pressurized oxygen at an unquantified pressure needed in order to urge the gasoline in a liquid state up through screens. The screens act as agitators. There is no second throttle is this carburetor replacement device.

U.S. Pat. No. 1,142,674, which issued to T. C. Crouch on Jun. 8, 1915, titled Fuel Atomizer For Internal Combustion Engine is an atomizer for heavy fuels, such as kerosene. The plurality of sheets are bent outward, except for the central sheet so that the screens are positioned different than those of the present device. Also, this patent fails to provide for the necessity of a second throttle, or the type of screen set forth in the present device. See also, U.S. Pat. No. 1,260,609, which issued to J. W. Warren on Mar. 26, 1918, titled Mixer that uses one screen, again without a disclosure of the mesh count and without the second throttle. Both of these patents utilize a stock carburetor to supply the air and fuel mixture, and these items would fail if the carburetor was maintained at one setting, or partially disabled, as is the case with the present device.

U.S. Pat. No. 1,265,047, which issued to A. J. Canova on May 7, 1918, titled Gaseous Fuel Mixer is positioned above the carburetor which is a different location in the induction system than the present device. Also, the screens in this mixer function like a butterfly valve, and do not affect the constant velocity of the air and fuel flow. Further, this mixer does not provide for a second throttle and, it appear, would fail to perform if the carburetor was maintained at one setting.

U.S. Pat. No. 1,307,393, which issued to C. M. Dyer on Jun. 24, 1919, titled Fuel Vaporizer is directed to a vaporizer that is a casing having a plurality of gauze vaporizing screens fitted in a removable but gas tight manner in the outer jacket. The screens are spaced from one another, and each gauze has about sixteen wires to the inch, but the size can vary to some extent. This vaporizer requires the addition of heat. Also, the screens are positioned different, and the size of the mesh different than that of the present device. Moreover, this vaporizer does not teach the use of a second throttle in conjunction with maintaining a single setting for the carburetor.

U.S. Pat. No. 1,394,820, which issued to J. H. Fritz on Oct. 25, 1921, titled Mixing Device For Explosive Engines provides for mixing of the ingredients of a charge by the use of a screen disposed between two relatively coarse screens superposed one on the other and mounted in an annular recess in the outer side of an annular member that bears against the outer side of the cylinder. This device is not positioned between the outlet of the carburetor and the inlet of the engine manifold as is the present device. In addition, this mixing device does not provide for the multiple functioning screens, or mesh count or second throttle of the present device.

U.S. Pat. No. 2,701,557, which issued to A. J. Ramey on Feb. 8, 1955, titled Atomized and Mixing Device For Internal-Combustion Engines is directed to a device that specifically is not positioned between the fixed outlet of the carburetor and the inlet of the engine manifold. The mixing device has a screen located at the intake manifold to partially atomize the liquid fuel and a bladed element having plurality of vanes disposed adjacent the inlet screen to impart a swirling motion to mix the fuel and air to more intimately mix the two together. There is also a plurality of screens disposed over openings in the lower wall of the housing to complete atomization. Clearly, the form and function of the screens in this device differ from that of the present device. In addition, this device does not provide for a second throttle or adjusting to a fixed setting the setting of the carburetor. See also, U.S. Pat. No. 2,899,949, which issued to J. B. Hicks on Aug. 18, 1959, titled Device For Improving the Operation Of Internal Combustion Engine.

U.S. Pat. No. 4,361,128, which issued to H. Goldman on Nov. 30, 1982, titled Carburetor Insert Apparatus is directed to an insert for insertion between the carburetor and the firing chamber of the cylinders in an internal combustion engine. This apparatus or insert comprises a cylindrical cup-like configuration having a plurality of rectangular apertures symmetrically positioned about the major side surfaces and having a pattern of small apertures located in the bottom surface. First and second circular screens members are positioned in the insert to overlie the bottom surface, and a cylindrical screen is positioned in the hollow insert to surround the major side surfaces containing the rectangular apertures. A dispersing fan and auxiliary heat are used. The present device does not use heat and, in fact, avoids heat. Also, the present device does not use a dispersing fan. Further, the arrangement of the screens are different between this apparatus and the present device. Still further, this apparatus also does not use a second throttle or maintain a single setting of the carburetor.

U.S. Pat. No. 4,974,573, which issued to M. J. Jensen on Dec. 4, 1990, titled Intake Manifold Fuel Multi-Layer Atomizing Screen is directed to concentric cylinder form, concentric truncated conical form or spiral wound form screens, with the number of screens in direct portion to the number of barrels of the carburetor. The screens, their function and the failure to use a second throttle, as well as a failure to teach maintaining a single setting of the carburetor, clearly distinguishes this atomizing screen from the present device.

Other patents illustrate mixing the fuel and the air before entering the vehicle engine in order to optimize fuel efficiency. U.S. Pat. No. 4,858,582, which issued to P. M. Brown on Aug. 22, 1989, titled Carburetor Fuel Preconditioner is directed to a carburetor fuel preconditioner for internal combustion engines. The preconditioner creates desired fuel vapor-air mixture by passing air through a bubble chamber that holds the gas. The chamber has a multiplicity of catalytic beads that are immersed in the gasoline and through which the air is passed. The catalytic beads provide an extensive absorption area for both the gasoline and the air for microscopic mixing of both. The catalytic beads also cause cracking of the gasoline's molecular chains to raise the volatility and octane of the gas for greater combustion efficiency. See also, U.S. Pat. No. 484,721, which issued to J. J. Parris on Oct. 18, 1892, titled Carburetor Apparatus. Also note, U.S. Pat. No. 671,042, which issued to D. Barckdall, et al. on Apr. 2, 1901, titled Carburetor for making gasoline.

Foreign reference No. 3,135,813, made of record in the priority application, is directed to filters for filtering particles and is clearly different than the present device.

Other patents simply provide for agitation of fuel to form a better fuel, such as, U.S. Pat. Nos. 3,278,032, which issued to R. F. Smith on Oct. 11, 1966, titled Fuel Pump and Filter Assembly and 4,253,954, which issued to D. G. Midkiff, et al. on Mar. 3, 1981, titled Two-Stage Spin-On Separating Device.

Still other patents monitor the fuel and air delivered to the vehicle's engine in order to maximize fuel efficiency. For example, U.S. Pat. No. 4,368,712, which issued to K. A. Jackson, et al. on Jan. 18, 1983, titled Vaporized Gasoline Fuel System and Control Thereof is directed to a vaporous gasoline fuel system that has an electronic monitoring and control system to monitor the combustion of the vaporized fuel and air delivered to the engine in response to a change in the engine's fuel demand. The optimum ratio of fuel to air in the vaporized fuel mixture is thus maintained. Also, U.S. Pat. No. 4,011,847, which issued to R. D. Fortino on Mar. 15, 1977, titled Fuel Supply System is directed to a fuel system that supplies gasoline to a vehicle's carburetor. The gasoline mixes with air in a controlled manner in order to provide a fuel charge for combustion within the cylinder of an internal combustion engine.

Yet other patents have attempted to convert fuel to another form before mixing it with air. In particular, U.S. Pat. No. 4,430,095, which issued to J. J. Gilbert on Feb. 7, 1984, titled Gaseous Mixture From Liquid Fuel and Air is directed to converting liquid fuel, such as gasoline, into a gaseous form. The gaseous fuel is uniformly mixed with a flow of air for efficient burning in a combustion apparatus.

U.S. Pat. No. 4,426,984, which issued to J. J. Gilbert on Jan. 24, 1984, titled Apparatus For Entraining Gasoline In Air For Use In An Internal Combustion Engine is an apparatus that converts volatile combustion liquids, such as gasoline, methanol and the like into aeriform gas. Basically, compressed air is passed through a filter containing a desiccant to remove any moisture and is then introduced into a container that holds the gasoline to diffuse the demoisturized air through the gasoline and thereby expand the volatile liquid gasoline. Evaporated gases rise in the container and are drawn through a solid porous structure of about 120 microns. The evaporated gases broken into finer particles and passed through another porous structure of about 90 microns and then through a chemically treated activated charcoal cartridge. This provides for a minimal amount of expansion of the oxygen with the hydrocarbon. See also, U.S. Pat. No. 370,936, which issued to T. Drake on Oct. 4, 1887, titled Carburetor Apparatus.

U.S. Pat. No. 1,276,937, which issued to J. McKenney on Aug. 27, 1918, titled Carburetor is directed to producing gas by enriching the air with hydrocarbons.

Thus, the present device is fundamentally different than those set forth in the above patents. In particular, the present device provides two features that allows it to function, and these constants are neither disclosed nor suggested in the above patents. Due to the size and shape of the perforations, and the number of screens used in the device, the carburetor's throttle must be modified to supply less fuel and air. If too much of the mixture of fuel and air is introduced into the device, the engine will stop. Nonetheless, maintaining this minimal, yet constant, amount of fuel and air mixture supplies the engine with its fuel demand from a full range of speeds, namely idle to full throttle. Thus, the modification is a partial disabling of the carburetor to the extent that the carburetor's throttle is fixed in one position in which a minimal amount of fuel necessary is supplied to maintain the running of the engine. By doing so, the accelerator pump within the carburetor is limited to supply the reduced amount of fuel at a basically constant rate regardless of the engine's rpm. This constant, minimal amount of fuel is then mixed with a minimal amount of air that is also held constant by the fixed position of the carburetor's throttle.

Since the carburetor's throttle has been partially disabled, a second throttle is needed to control the amounts of fuel and air that leave the device and enter into the engine's intake manifold. Thus, the present device differs from the apparatus of the above patents in that the present device requires a second throttle. Also, the first or conventional carburetor throttle remains set in order to effect the proper mixture and initial volume of air and fuel, while the new, second throttle controls the overall volume of mixture into the engine. This two throttle arrangement has been found to produce the most efficient use or consumption of fuel, while obtaining remarkably minimal amounts of unwanted emissions.

SUMMARY OF THE INVENTION

Against the foregoing background, it is a primary object of the present invention to provide a device that provides improved fuel efficiency and a reduction in unwanted fuel emissions.

It is another object of the present invention to provide such a device that is positioned between the carburetor throttle or outlet of the carburetor and the inlet of the engine manifold.

It is still another object of the present invention to provide such a device that includes screen means fixed in position in tile device, and a second throttle.

It is yet another object of the present invention to provide such a device in which the screen means is six to twelve screens.

It is a further object of the present invention to provide such a device in which the screen means includes is six screens.

It is a still further object of the present invention to provide such a device that places the six screens in three distinct locations in the device with two screens superposed at each location.

It is a further object of the present invention to provide such a device that is particularly suited for a lawn mower engines.

To the accomplishments of the foregoing objects and advantages, the present invention, in brief summary, comprises a fuel saving device that is adapted to be connected between the outlet port of a carburetor and the inlet port of a manifold of an engine. The device comprises a hollow housing having a first end adapted to engage the outlet port of the carburetor and a second end adapted to engage the inlet port of the engine manifold, a plurality of screens positioned in the housing, wherein the plurality of screens consists of from six to twelve screens, and a throttle positioned in the housing between the screens and the second end.

In a preferred embodiment, there are six screens. The screens are positioned at three different locations in the device. At each location, the pair of screens are superposed one on another. The distance between each location should be one inch or less, e.g. the distance between the exterior of the screens at the two locations should be one inch or less. Also, the distance between the first location of screens and the first end, and the distance between the third location of screens and the second end, should be one inch or less,

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

BRIEF DESCRIPTION OF THE PREFERRED EMBODIMENTS

Figure 1:
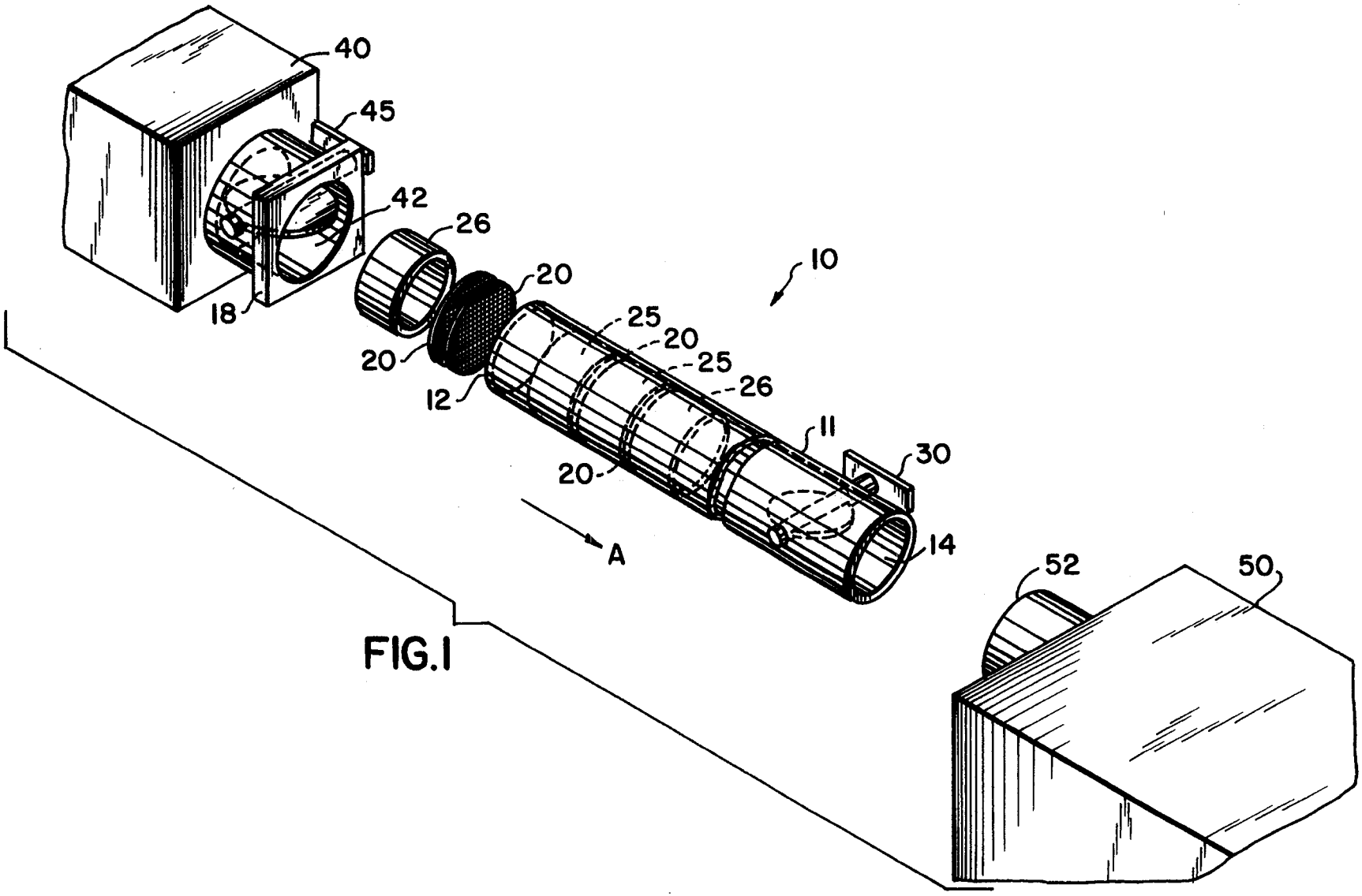
FIG. 1 is an exploded view of the device shown positioned between the carburetor and engine manifold.

Referring to the drawings and, in particular, FIG. 1, a device according to the present invention is generally represented by reference numeral 10. The device 10 is adapted to be positioned between the outlet port 42 of a carburetor 40 and the inlet port 52 of an engine manifold 50. The carburetor 40 and engine manifold 50 comprise the components of a combustion engine. Such an engine is normally used in lawn mowers, automobiles and other motorized vehicles. As with all such engines, the carburetor 40 has a first throttle 45 that by position controls the mixture and the amount of air and fuel that emits from the carburetor in the direction toward the engine manifold 50 as shown by arrow A.

The device 10 has a hollow housing 11 with a first end 12 and a second end 14. The first end 12 is adapted to be connected to the outlet port 42 of the carburetor 40, and the second end 14 is adapted to be connected to the inlet port 52 of the engine manifold 50. The connection of the first end 12 to the outlet port 42 and the second end 14 to the inlet port 52 is by any conventional connectors 18, such as, for example threaded or cast pieces, flexible clamps, threaded pieces or cast connectors. These connectors 18 must provide good insulation to prevent or minimize excess condensation and moisture on the inside of the housing 11 since such excess condensation or moisture will cause the engine to stop.

While the shape of the housing 11 should not have any consequence on the performance of the device 10, the cylindrical shape, shown in the figures, is preferred since the cylindrical shape apparently deflects the air and fuel so as to permit the engine to run the longest amount of time on a constant amount of fuel and air. It is believed that the housing 11 can have an elongated, flat shape but, again, such a shape is not preferred.

The elongation or length of the housing 11 and the inside diameter of the housing depend upon the application, e.g. the engine in which the device 10 will be used. The length of the housing 11, however, needs to be only long enough to provide for three locations if the preferred embodiment of the device is used. Each location needs to be only one-quarter inch apart. Also, the inside diameter of the housing 11 should be no smaller than the inside diameter of the inlet port 52 of the engine. The inside diameter of the housing 11 can be as large as ergonomically practical.

The device 10 includes a plurality of screens 20 and a throttle 30. As defined herein, a screen is any frame having mesh that provides a plurality of apertures or perforations or holes.

Each screen 20 should be of the same size and shape, and the shape of each screen 20 should conform to the inside surface of the device 10. In addition, each screen 20 should be sized so as to touch the inside surface of the device 10 in order to prevent fuel and air from passing between the perimeter of the screen and the inside surface of the device 10, but should not be too tight so as to impair the ability to remove the screen from the device.

Figure 2:
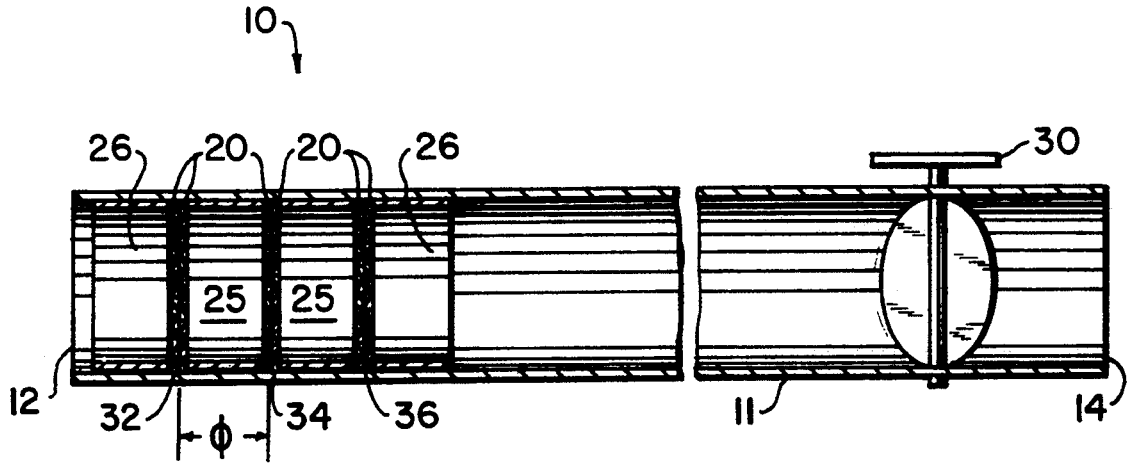
FIG. 2 is a partial sectional view of the device shown in FIG. 1.

In the preferred embodiment shown in FIGS. 1 and 2, the screens 20 should be positioned at three different locations 32, 34 and 36 in the device 10. To maintain the position or separation between each location, a spacer 25 is used between each location. Thus, in the preferred embodiment shown in FIGS. 1 and 2, two spacers 25 are used. In addition, a spacer 26 is used adjacent each end 12 and 14 of the device 10 in order to prevent the screens 20 and spacers 25 from shifting within the device when the device is in its operative position.

The spacers 25 and 26 can be any conventional spacer, such as, for example, a hollow, elongated ring, that permits the screens to be removably fixed into their positions with respect to the other locations. Each spacer 25 and 26 should be hollow in order not to affect the flow of air and fuel through the screens 20. Each spacer 25 and 26 should be made of a material, such as, for example, stainless steel, that is not chemically affected by the fuel.

Each spacer 25 should be of an axial length to provide the desired spacing between each adjacent location. One spacer 26 should have an axial length to accommodate the distance between the first end 12 and the first location 32, while a second spacer 26 should have an axial length to accommodate the distance between the throttle 30 and the third location 36.

In a preferred embodiment of the present invention shown in FIG. 2, the screens 20 are positioned in three separate locations 32, 34 and 36. The distance between each location, as measured from the midpoint of each location, is shown as $\phi$. That distance should be one inch or less in order to obtain maximum efficiency. In this preferred embodiment, two screens 20 are positioned at each location 32, 34 and 36. The two screens 20 at each location are superposed one on the other. It is believed that the two screens should be as close as possible without compressing the screens together in order to achieve maximum efficiency.

The throttle 30, which is physically located in the device, is positioned no more than six inches from the third location 36. The throttle has been tested as close as one-half inch from the last location of screens and the best results were achieved. Between one-half inch and one inch appears to have the best response time. Theoretically, the throttle may respond well even if placed abutting the last location. The throttle is a conventional throttle, such as, for example, butterfly type design, that acts to selectively adjust the amount of air and fuel entering the engine manifold 50.

Figure 3:
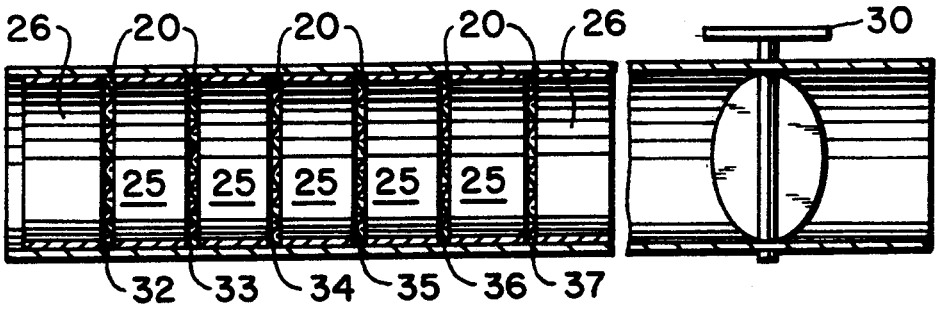
FIG. 3 is a partial sectional view of an alternative embodiment of the device of FIG. 1.

In an alternative embodiment shown in FIG. 3, the screens are each separated from one another by a distance one inch or less. Thus, in this embodiment, there are six different locations or positions 32 through 37 where the screens are placed within the device 10. Also, there are five spacers 25 to maintain the separation between the six screen locations.

Figure 4:
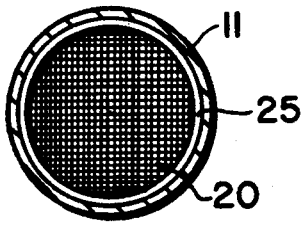
FIG. 4 is a front view of a screen in tile device of FIG. 1.
Figure 5:
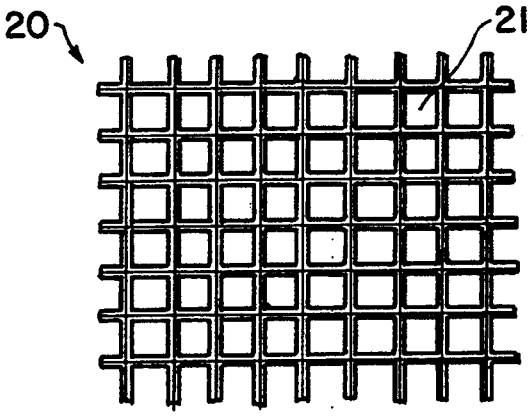
FIG. 5 is a magnified view of a portion of tile screen of FIG. 4.

Referring to FIG. 4, the shape of the screen 20, as stated above, is complementary to the inside surface of the housing 11 to avoid having the fuel pass therebetween. Each screen 20 is any mesh or perforated substrate. However, the holes or perforations 21 in the substrate should be of a square configuration as shown more clearly in FIG. 5. In addition, each screen 20 should have a mesh count ranging from 200 to 400 perforations per square inch. Testing has shown, however, that each screen 20 preferably has a mesh count 244 perforations or holes per square inch for optimal performance. Thus, each hole is approximately 0.0022 sq. inches.

Each screen 20 should be made of a material that does not chemically react with the fuel and, thus, is not adversely affected by the fuel. Such a material is stainless steel. The thickness of each screen 20 should preferably be about 0.0016 inches.

In the preferred embodiment shown in FIG. 3, there are two screens positioned one on the other at each location 32, 34 and 36. While superimposed, the square shaped holes should not align themselves with one another in order to provide a torturous path.

It has been found through testing that for optimal performance six screens is preferred. Each trial or test was run for fifteen minutes prior to the emission test at 3,000 rpm on a Briggs and Stratten five horsepower engine having approximately two hundred hours of use. The computer probe was inserted for thirty seconds. As shown by the following, the present device can employ from six to twelve screens, but the optimization of the reduction of unwanted emissions decreases as the number of screens increase from six as set forth below. The screens were spaced in three locations with each adjacent pair of locations less than one inch apart. The six screen test had a pair of screens at each of the three locations. The even screen test had a pair of screens at the first and second locations and three screens at the third location, while the eight screen test had a pair of screens at the first location and three screens at the second and third locations. The nine screen test had three screens at each location, while the twelve screen test had four screens at each location. The ten and eleven screen test followed the sequence of odd number screens of that of the seven and eight screens test, respectively.

| Number of screens | Hydrocarbons ppm | Carbon monoxide % |
|---|---|---|
| 6 | 40 to 50 | .08 to .13 |
| 7 | 40 to 50 | .09 to .11 |
| 8 | 40 to 50 | .12 |
| 9 | 50 to 55 | .17 to .20 |
| 10 | 45 to 50 | .17 |
| 11 | 55 to 60 | .20 to .23 |
| 12 | 55 to 60 | .50 to .70 |

It was observed that as the number of screens increased, there was a loss of throttle response. In addition, there was observed a loss in the running stability of the engine, e.g. the engine ran unevenly.

Referring again to the FIG. 2 embodiment of the present device 10, three tests, namely an emission evaluation, running time comparison and wear test, were performed in a laboratory setting. Two different engines manufactured by Briggs and Stratton were tested. One engine is a series 92502 three horsepower model engine, and the other engine is a series 12000 five horsepower model engine, both of which are new. Each engine was run on a certified 87 octane grade gasoline and used a certified grade 10W30 motor oil. Each engine was tested as is, that is a stock engine, and with the stock engine modified to include the preferred device shown in FIG. 2.

The exhaust emissions were derived using a "Sun Inspector" exhaust gas analyzing computer, model SUN 1045. The emissions report focused primarily on carbon monoxide and hydrocarbon emissions.

The running time for each tested engine is shown below in Table 1. The running time was based on the length of time the five horsepower engine ran at 3,000 rpm on thirty-six ounces of 87 octane fuel, and the three horsepower engine ran at 3,600 rpm on one quart of 87 octane fuel. On thirty-six ounces of fuel, the five horsepower stock engine ran for about ninety minutes, while the same engine modified with the preferred embodiment of the present device, shown in FIG. 2, ran between about one hundred and sixty and about two hundred and ten minutes. On one quart of fuel, the three horsepower stock engine ran for about seventy minutes, while the same engine modified with the preferred embodiment of the present device, shown in FIG. 2, ran between about ninety and about one hundred and twenty minutes.

TABLE 1

| Stock engine | Modified engine |
|---|---|
| 3 Hp engine | |
| 70 minutes | 90 to 120 minutes |
| 5 Hp Engine | |
| 90 minutes | 160 to 210 minutes |

It should be noted that the three Hp engine was placed on a lawn mower and tested on a lawn during a sunny, low humidity, about 85 degree Fahrenheit temperature day. It was observed that no loss of power or performance occurred, and that the device improved both hot and cold starting ability by about one hundred percent. However, four pulls were needed to start the stock engine when cold, whereas one pull was needed to start the modified engine when cold. Furthermore, the choke was needed to start the stock engine, but it was not needed to start the modified engine.

Table 2 compares hydrocarbon levels in parts per million between the three horsepower stock engine and with the device placed into position (modified). Table 3 compares the percent carbon monoxide derived from the three horsepower stock engine and that engine modified with the device. Likewise, Table 4 compares hydrocarbon levels in parts per million of the five horsepower stock engine and that engine modified with the device, while Table 5 compares the percent carbon monoxide of the five horsepower stock engine and that engine modified with the device.

TABLE 2

| Stock engine | Modified engine |
|---|---|
| 9999 ppm | 550 ppm |

TABLE 3

| Stock engine | Modified engine |
|---|---|
| 5.50 | 0.200 |

TABLE 4

| Stock engine | Modified engine |
|---|---|
| 200 ppm | 40 ppm |

TABLE 5

| Stock engine | Modified engine |
|---|---|
| 6.40 | 0.07 |

In order to assess engine wear, the five horsepower engine was run an average of eight continuous hours per day for two hundred and eighty-three hours. The engine was then disassembled and the tolerances were measured and compared as shown in Table 5 against the manufacturer's recommendations for excess wear.

TABLE 5

| | Excess wear *IL/IS* | Wear after 283 hours |
|---|---|---|
| Cylinder bore | 2.6885 IL | 2.6860 |
| Crankshaft: | | |
| Main journal | 0.996 IS | 0.999 |
| Power takeoff journal | 1.060 IS | 1.062 |
| Magneto journal | 0.873 IS | 0.876 |
| Piston Rings: | | |
| End gap | | |
| Compression | 0.035 IL | 0.008 |
| Oil ring | 0.045 IL | 0.026 |

*IL means if larger
IS means if smaller

Thus, the present device 10 has been found to provide improved fuel efficiency and a reduction in unwanted fuel emissions, but without any unusual engine wear. These tests were preformed to quantify the use of the device in two and four stroke lawn mower engines. Preliminary tests on automobiles and the like have indicated that the same results will also be achieved for such engines.

Apparently, the present device 10 acts as a final molecular proportioning stage for air and fuel after the reduced mixture has been initially atomized by the carburetor or fuel injector and before the fuel enters the combustion chamber or engine manifold.

Figure 6:
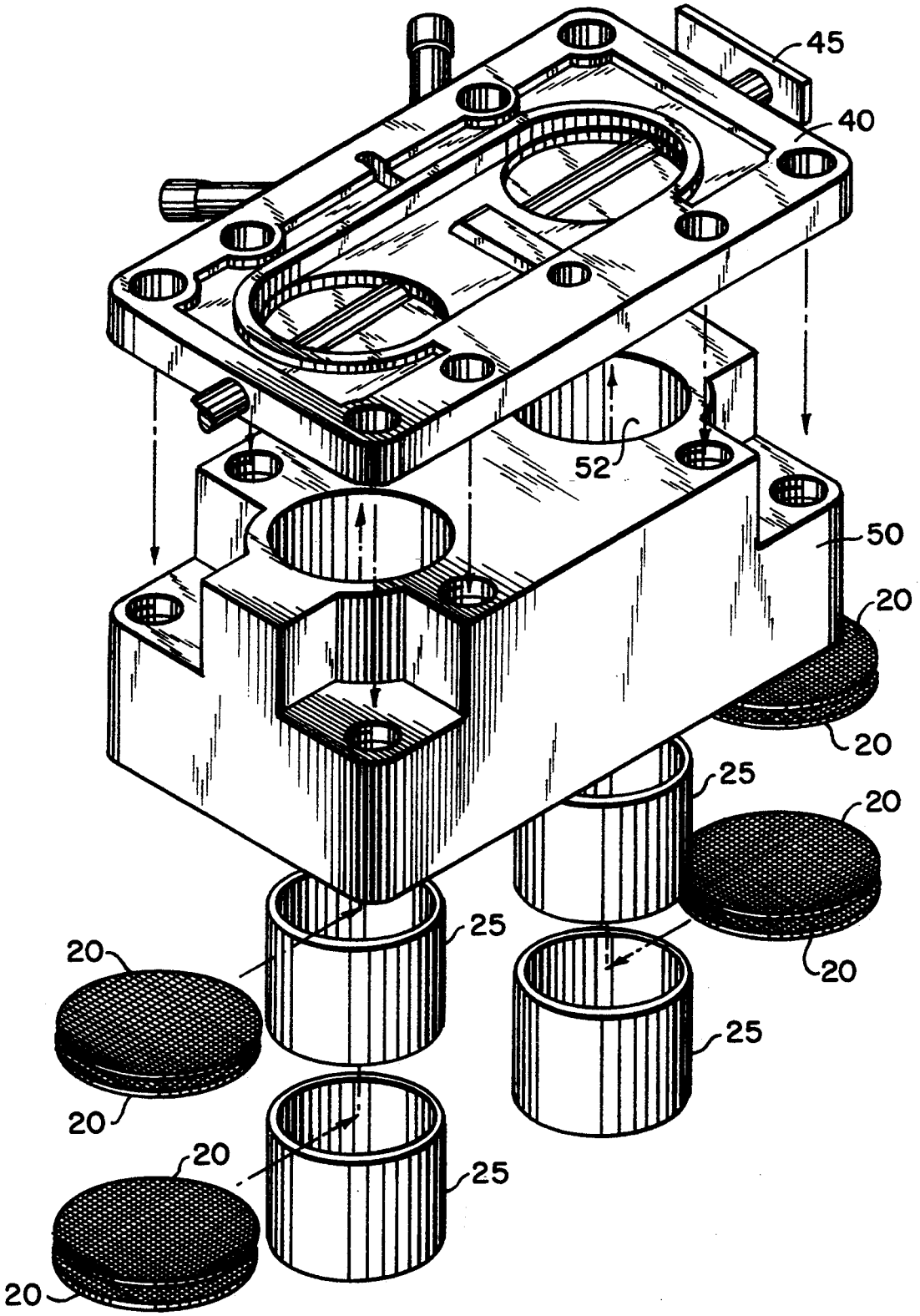
FIG. 6 is an exploded sectional view of an engine with a two barrel carburetor showing placement of one device in each carburetor barrel.

FIG. 6 illustrates the use of two devices in each barrel of a two barrel carburetor. It is envisioned that a device would be installed in each barrel of the carburetor. The particular two barrel carburetor shown in FIG. 6 would be used in an automobile, instead of a lawn mower engine. Nonetheless, the present device is adapted to be installed in all carburetor or fuel injected engines.

Just as with the device of FIG. 1, each device 10 shown in FIG. 6, is adapted to be positioned between the outlet port 42 of a carburetor 40 and the inlet port 52 of all engine manifold 50. The first or carburetor throttle 45 will be fixed into a single position to provide constant, but minimal, amounts of fuel and air. The first end 12 of the device 10 is adapted to be connected to the outlet port 42 of the carburetor 40, and the second end 14 is adapted to be connected to the inlet port 52 of the engine manifold 50. The device 10 includes the plurality of screens 20 and the throttle 30. In the preferred embodiment, the screens 20 should be positioned at three different locations 32, 34 and 36 in the device 10 shown in FIGS. 1 and 2.

Having thus described the present invention with particular reference to the preferred forms thereof, it will be obvious that various changes and modifications may be made therein without departing from the spirit and scope of the invention as defined by the appended claims.

Wherefore, we claim:

1. A fuel saving device adapted to be connected between the outlet of a carburetor having a throttle and the inlet of an engine manifold of an internal combustion engine to improve the molecular proportions of air and fuel passed through the engine, wherein the throttle of the carburetor is modified to emit a constant amount of fuel and air through the outlet of the carburetor, the device comprising:

a hollow housing having a first end adapted to engage the outlet of the carburetor and having a second end adapted to engage the inlet of the engine manifold;

a plurality of screens positioned in the housing, wherein the plurality of screens is between six and twelve screens; and means, positioned in the housing between the plurality of screens and the second end, for selectively controlling the amount of the air and fuel that enters into the engine.

2. The device of claim 1, wherein the plurality of screens is six screens.

3. The device of claim 2, wherein the six screens are separated into three pairs of screens, and wherein each pair of screens is positioned at a different location in the device.

4. The device of claim 3, wherein each one of the pair of screens are superposed on the other one of the pair of screens.

5. The device of claim 3, wherein the distance between each adjacent pair of locations should be one inch or less.

6. The device of claim 3, further comprising means for maintaining the plurality of screens at each location.

7. The device of claim 6, wherein the maintaining means includes means for maintaining the spacing between each pair of locations.

8. The device of claim 7, wherein the spacing maintaining means is a plurality of spacers, and wherein each spacer is used between each location to maintain the separation between each location.

9. The device of claim 8, wherein the maintaining means further includes means for preventing the plurality of screens and plurality of spacers from shifting in the device when the device is in its operative position.

10. The device of claim 9, wherein the preventing means is a set of second spacers.

11. The device of claim 1, wherein each one of the plurality of screens may be positioned at different locations within the device.

12. The device of claim 11, further comprising means for maintaining the plurality of screens at each location.

13. The device of claim 12, wherein the maintaining means includes means for maintaining the spacing between each pair of locations and means for preventing the plurality of screens from shifting in the device when the device is in its operative position.

14. The device of claim 1, wherein each one of the plurality of screens has a plurality of perforations that are square in shape.

15. The device of claim 1, wherein each one of the plurality of screens has a mesh count ranging from 200 to 400 perforations per square inch.

16. The device of claim 1, wherein each one of the plurality of screens has a mesh count of 244 perforations per square inch.

17. The device of claim 1, wherein each one of the plurality of screens is made of stainless steel.

18. A fuel saving device adapted to be connected between the outlet of a carburetor having a throttle and the inlet of an engine manifold of an internal combustion engine to improve the molecular proportions of air and fuel passed through the engine, wherein the throttle of the carburetor is modified to emit a constant amount of fuel and air through the outlet of the carburetor, the device comprising:

a hollow housing having a first end adapted to engage the outlet of the carburetor and having a second end adapted to engage the inlet of the engine manifold;

six screens positioned in the housing, wherein the six screens are separated into pairs with each pair separated from an adjacent pair by a desired distance; and means, positioned in the housing between the six screens and the second end, for selectively controlling the amount of the air and fuel that enters into the engine.

19. The device of claim 18, further comprising means for maintaining the six screens in position in the device.

20. The device of claim 18, wherein each of the six screens has a mesh count of 244 perforations per square inch.

21. The device of claim 20, wherein each perforation is 0.0022 square inches.

22. A fuel saving device adapted to be connected between the outlet of a carburetor having a throttle and the inlet of an engine manifold of an internal combustion engine to improve the molecular proportions of air and fuel passed through the engine, the device comprising:

means for emitting a constant amount of fuel and air through the outlet of the carburetor;

a hollow housing having a first end adapted to engage the outlet of the carburetor and having a second end adapted to engage the inlet of the engine manifold;

a plurality of screens positioned in the housing, wherein the plurality of screens is between six and twelve screens; and means, positioned in the housing between the plurality of screens and the second end, for selectively controlling the amount of the air and fuel that enters into the engine.

23. The device of claim 22, wherein the plurality of screens is six screens.

* * * * *